United States Patent [19]

Termohlen

[11] 3,981,109

[45] Sept. 21, 1976

[54] PROCESS AND APPARATUS FOR SUPPORTING HOISTED FLOORS PERIPHERALLY OF SUPPORTING TOWER

[75] Inventor: David E. Termohlen, Greenwich, Conn.

[73] Assignee: International Environmental Dynamics, Inc., New York, N.Y.

[22] Filed: Oct. 24, 1974

[21] Appl. No.: 517,682

[52] U.S. Cl. ..... 52/126; 52/236; 52/745

[51] Int. Cl.[2] ..... E04B 1/00

[58] Field of Search ..... 52/126, 236, 73, 83, 52/745, 234; 61/46, 46.5, 67, 65; 254/108, 109, 11, 133 R

[56] References Cited

UNITED STATES PATENTS

| | | | |
|---|---|---|---|
| 3,028,707 | 4/1962 | Sagalovitch | 52/126 X |
| 3,096,076 | 7/1963 | Walli | 52/745 X |
| 3,156,071 | 11/1964 | Bijlevelt | 52/126 X |
| 3,507,080 | 4/1970 | Van Hezik | 52/236 X |

*Primary Examiner*—J. Karl Bell

*Attorney, Agent, or Firm*—Townsend and Townsend

[57] ABSTRACT

An apparatus is disclosed for the improved support of floors extending peripherally outward from a central tower in a building construction. The central supporting tower typically of concrete and formed by conventional slip-form methods, has imbedded in it at the intended floor elevations a series of horizontally disposed receptacles, each receptacle opening outwardly toward the tower sidewalls. Floors are constructed, typically in sequence, around the towers at the base of the towers. Thereafter, solid steel pull bars are inserted interiorly of the receptacles for their full length by inserting at the open end of the receptacles from the exterior of the tower sidewalls. The floors are raised in sequence with the top floor being raised first. Each floor is raised an elevation slightly above the elevation of its correspondent supporting pull bars. When the floor is immediately above the pull bar, the pull bar is moved partially outwardly so as to underlie the floor in supporting relation. When the requisite number of pull bars underlie the floor in supporting relation, the floor is lowered to come to rest at its final elevational position supported on the pull bars about the periphery of the tower.

20 Claims, 6 Drawing Figures

FIG_2
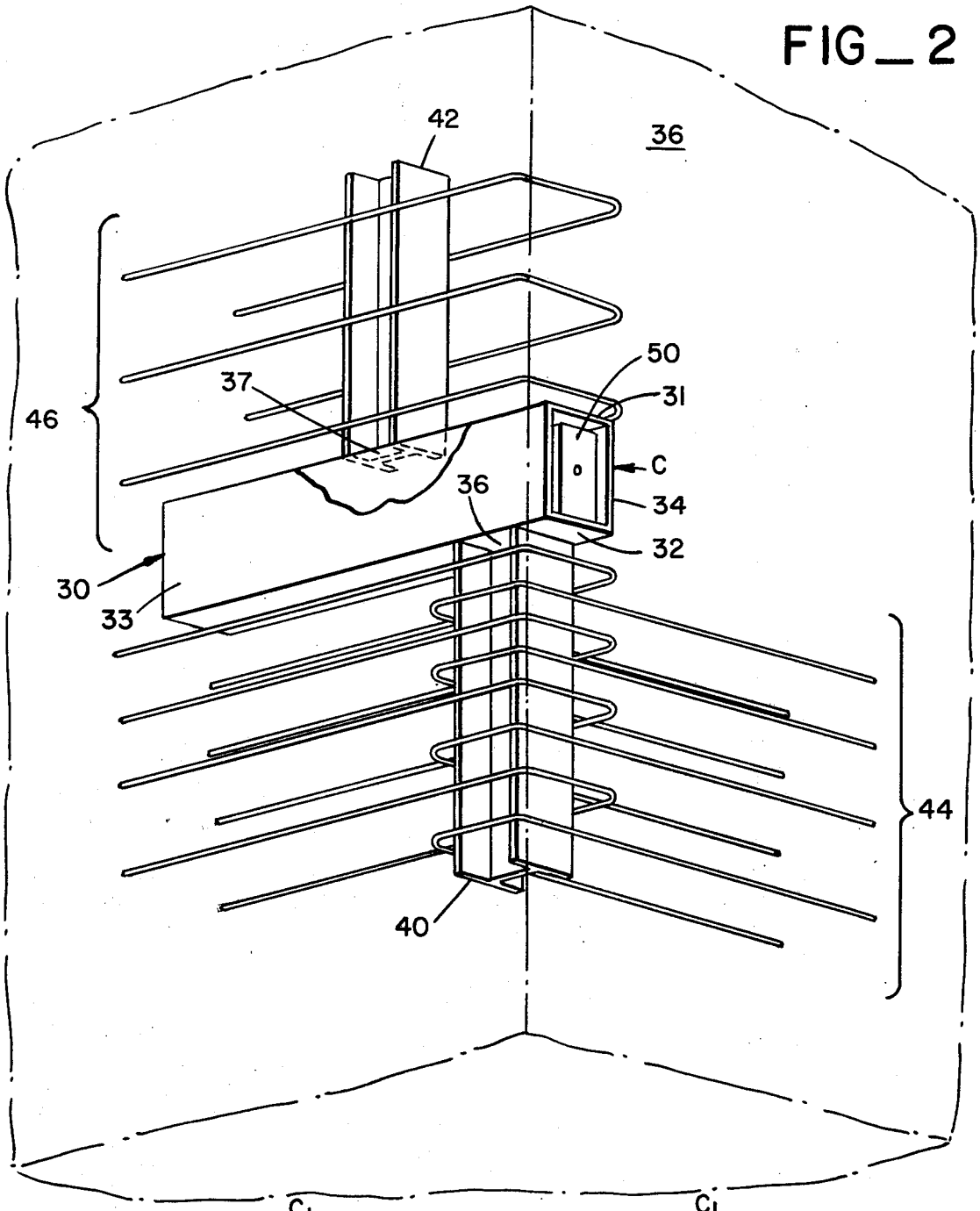
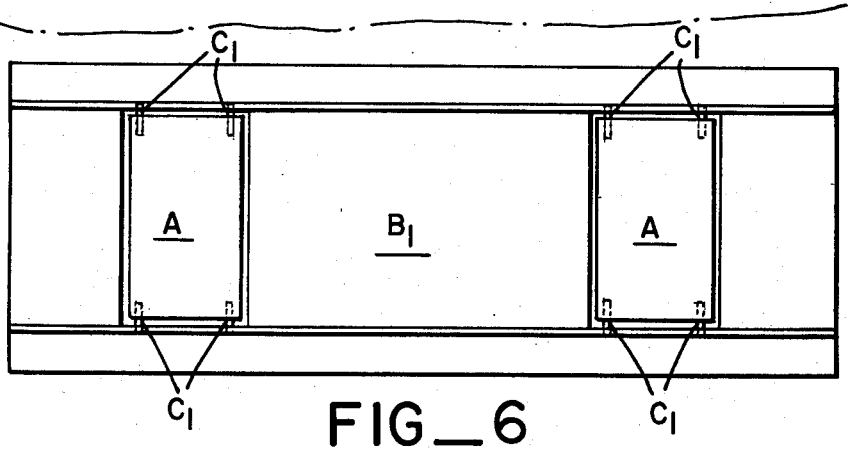
FIG_6

FIG_3
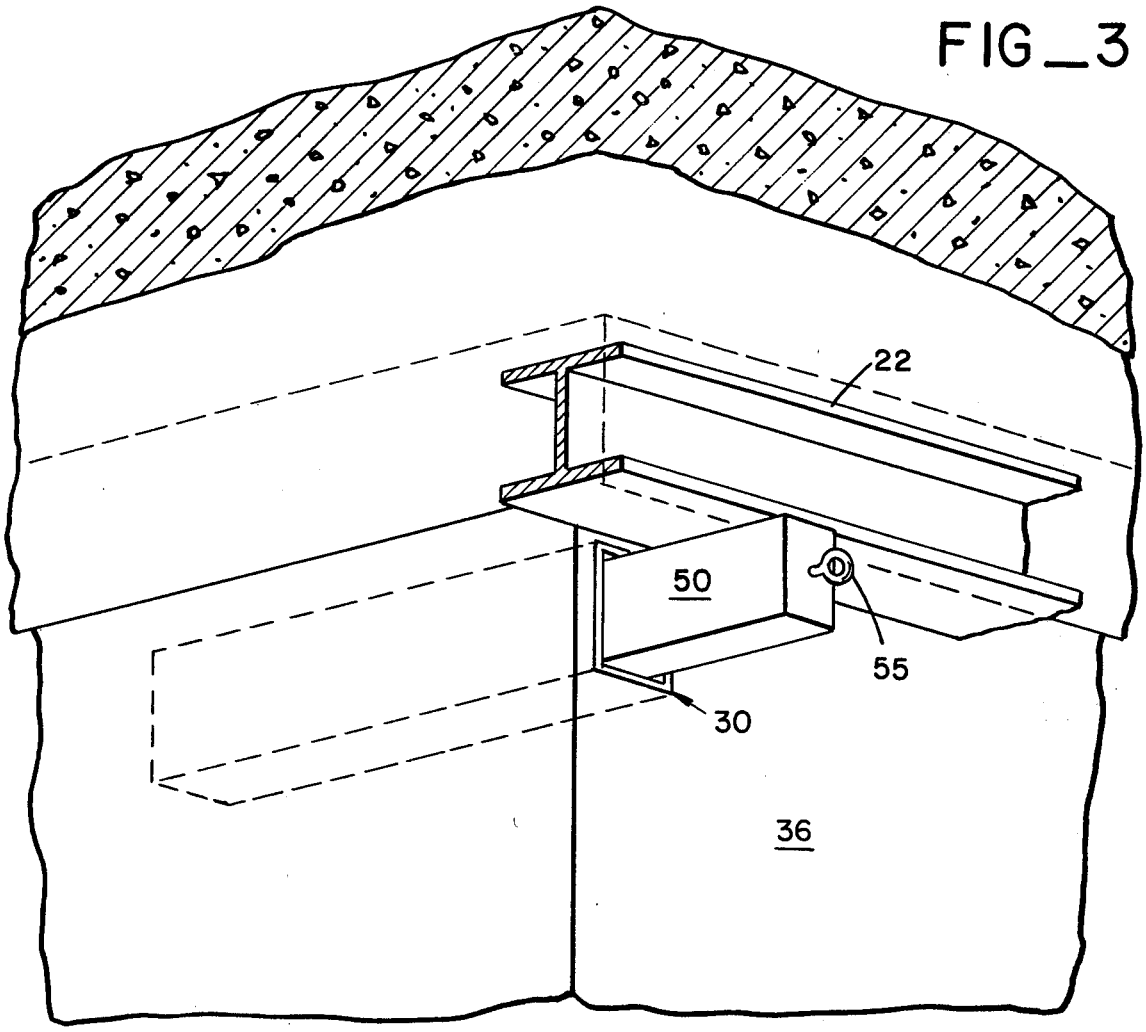
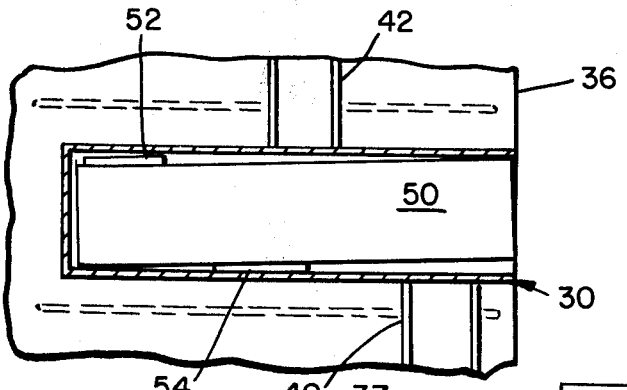
FIG_4
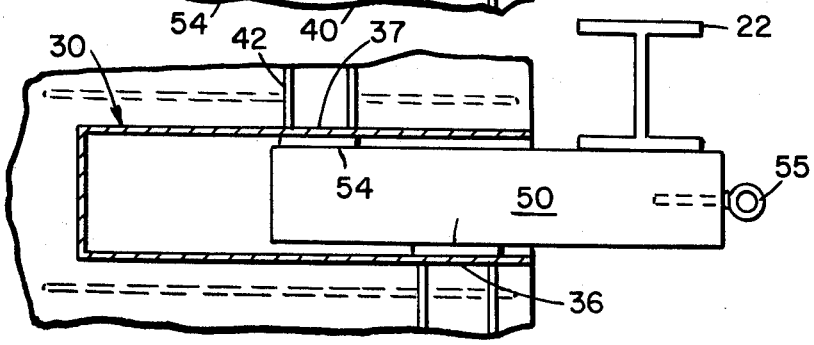
FIG_5

PROCESS AND APPARATUS FOR SUPPORTING HOISTED FLOORS PERIPHERALLY OF SUPPORTING TOWER

This invention relates to buildings having their floors supported about central supporting towers. More particularly, this invention discloses an improved apparatus and process for placing and supporting floors assembled at the base of the tower, their intended peripheral elevation by means of supports which telescope outwardly from the building sidewalls.

SUMMARY OF THE PRIOR ART

Buildings having central supporting towers with peripherally extending floors are known. See German Patent Specification No. 1,119,499 and Erbil U.S. Pat. No. 3,686,816.

In all such building constructions, the individual floors for such buildings are assembled at ground level around the base of the central supporting tower or towers. The floor at the tower has an aperture which aperture is larger in inside diameter than the outside tower diameter at the floor. When the floor is completed, it is hoisted to its intended elevation about the tower sidewalls. When the floor reaches its intended elevation, it must thereafter be fastened or supported on the tower in its intended elevation.

Heretofore, these supports fastening the floors to the tower have provided difficulty both in construction of the connecting members between the floor and supporting tower, as well as the construction procedure necessary to fasten the floor in place relative to the tower when the floor is elevated to its intended elevation.

One common method of supporting such floors about a tower has been to construct at the top of the tower a supporting truss or bridge. Thereafter cables, straps or other supporting members are placed dependingly downward from the top of the tower along the sides of the tower to support the floors. When the floors are elevated to their intended elevation, permanent attachment of the floors to the supporting straps or cables is made.

It has been found that the connection of such supporting straps or cables to the top of the building is expensive. Specialized supporting bridges or supporting saddles are required with correspondent expense. Moreover, the depending straps and cables required for floor support are expensive, and often must be assembled laboriously during building construction. Finally, attachment of the floors to supporting straps or cables is extremely difficult. Cable grips and the like are expensive, difficult to install, and subject to unpredictable corrosion which, in many building applications, is unacceptable.

Supporting straps have been transpierced with pins to hold the floors in place. Transpiercing requires precise registry of the floors relative to the supporting straps and pins. Finally, in such building construction, failure of the depending supporting members at any point results in overall catastrophic building failure.

Conventional fastening of the floors to the building sidewalls has one major difficulty. When the floors are raised past the building sidewalls, the floor apertures, which are typically contructed in a close tolerance to the lower sidewall, come in contact with any members previously installed to the tower sidewalls for intended floor support. Thus, where the floor is to be continuous from the tower sidewall, support by preinstallèd fasteners protruding outward from the tower sidewalls has heretofore not been possible.

SUMMARY OF THE INVENTION

A apparatus is disclosed for the improved support of floors extending peripherally outward from a central tower in a building construction. The central supporting tower typically of concrete and formed by conventional slip-form methods, has imbedded in it at the intended floor elevations a series of horizontally disposed receptacles, each receptacle opening outwardly toward the tower sidewalls. Floors are constructed, typically in sequence, around the towers at the base of the towers. Thereafter, solid steel pull bars are inserted interiorly of the receptacles for their full length by inserting at the open end of the receptacles from the exterior of the tower sidewalls. The floors are raised in sequence with the top floor being raised first. Each floor is raised an elevation slightly above the elevation of its correspondent supporting pull bars. When the floor is immediately above the pull bar, the pull bar is moved partially outwardly so as to underlie the floor in supporting relation. When the requisite number of pull bars underlie the floor in supporting relation, the floor is lowered to come to rest at its final elevational position supported on the pull bars about the periphery of the tower

OTHER OBJECTS AND ADVANTAGES OF THE INVENTION

An object of this invention is to disclose a building support apparatus which telescopes outwardly from the building sidewalls underlying a floor so that the floor may be supported peripherally about a central supporting tower.

An advantage of the telescoping floor support apparatus from the tower is that floors having apertures of close tolerance and constructed about the tower can be elevated to overlie the telescoped supports without contacting the supports during their elevation.

A further advantage of the floor support apparatus of this invention is that it permits a process of raising and supporting floors to a tower sidewall at their intended elevation.

Yet another advantage of the telescoping floor supports is that they can be activated to protrude outwardly of the supporting tower sidewalls only after the floor has been raised to its intended elevation relative to the supporting tower. By pulling the supports in from their telescope position interior of the tower when the floor is at its preselected elevational position and thereafter lowering the floor on the supports, full floor support can be achieved.

A further object of this invention is to disclose a support bar configuartion which can, with large tolerence, fit interiorly of the telescope within a supporting receptacle placed interiorly of the tower sidewalls. Typically, a solid steel bar of vertical outside dimensions less than the inside dimension of a supporting steel box, is provided with small shims. A first shim at the bottom of the pull bar underlies the pull bar at the bottom outside edge of the tower when the pull bar is moved to its floor supporting orientation. A remaining steel shim on the upper edge of the pull bar is typically at the rearward portion of the pull bar.

An advantage of the shims and pull bar in combination when placed interiorly of the pull bar supporting box or receptacle is that the bar can be moved into and out of the receptacle at an angle with resultant large clearances with respect to the receptacle sidewalls. Close tolerances between the pull bar and supporting receptale are not required.

Yet another advantage of the shims and pull bar is combination with the supporting receptacle is that the bar, when loaded, readily adapts to a leveled floor-supporting disposition.

Yet another object of this invention is to disclose an apparatus for imbedding the bar supporting receptacle interiorly of the tower sidewalls during construction. According to this aspect of the invention, steel beams are placed normally to the axis of the receptacle above and below pull bar supporting receptacle typically overlying the final position of the shims. These beams imbedded to the tower sidewalls by reinforcement and the like support the receptacle sidewalls at the point of shim contact to provide for a rigid and non-flexible interconnection between the loaded pull bar and receptacle.

An advantage of the steel beams is that they may be used as supporting surfaces for the floor supporting bars as the tower is constructed.

Other objects, features and advantages of the invention will be more apparent after referring to the following specification and attached drawings in which:

FIG. 2 is a perspective view illustrating in solid lines ther reinforcement of one of the typical pull bar assemblies and showing in broken lines the general outline of the tower section at the pull bar;

FIG. 3 is a perspective view of the pull bar after the floor has been raised with the pull bar moved outwardly in its floor supporting disposition;

FIG. 4 is a side elevation section of the pull bar within a receptacle.

FIG. 5 is a side elevation section of the pull bar pulled outwardly into a floor supporting disposition from the receptacle; and FIG. 6 is a bottom plan view of a floor as supported.

Figure 1:
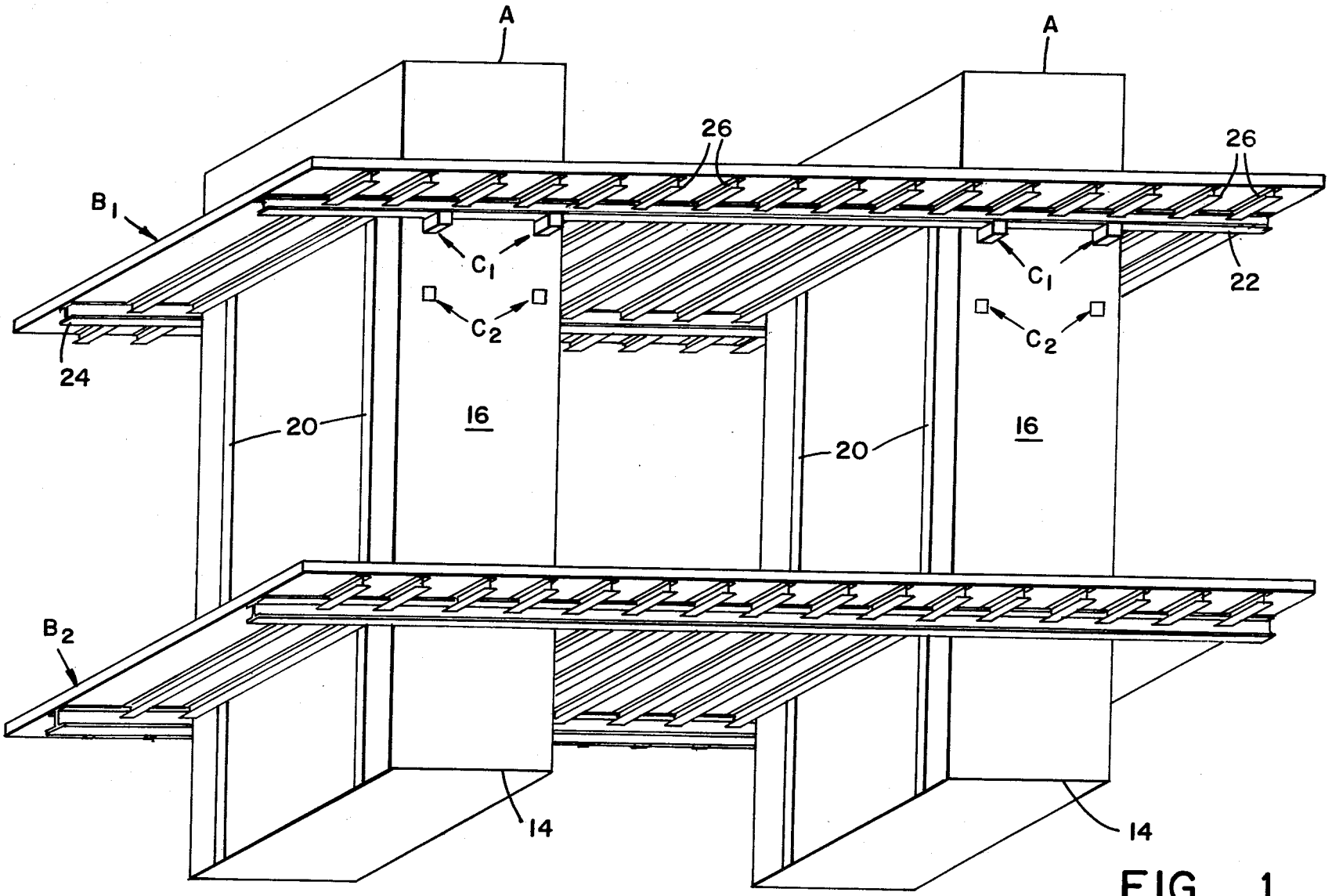
FIG. 1 is a ground elevation perspective view of a twin tower building showing the uppermost floor in place and supported by the pull bars of this invention with the immediately lower floors in the process of being raised along the building sidewalls.

Referring to FIG. 1, two floor supporting towers A are illustrated having a support at their respective foundations 14 and extending vertically upward to the top of the building. It will be noted that each of the towers A includes vertical wall 16 extending along the sides of the towers.

Floors B are first constructed about the base of the tower. As can be seen, floor B1 has been raised and is supported by the pull bar assemblies C1 which constitute the improvement of this invention. Floor B2 is in the process of being raised where it will be eventually supported by pull bar assemblies C2. Raising of the floors occurs by hydraulic jacks (not shown) traveling on feel rods 20. Such jacks can be obtained from the Heede International Company of Greenwich, Connecticut.

A brief description of the configuration of the floors is believed to be in order. Each of the floors includes two longitudinally extending beams 22, 24. These respective beams have fastened at right angles a series of transverse floor beams 26 spanning the width of the floor. As can be seen, the bottom flange of the beams 24 comes to rest on the pull bar structures C1 and C2 when the floor is lowered for support as hereinafter described.

Referring briefly to FIG. 6, which is a bottom plan view of this invention, it can be seen that floor B1 rests between towers A at a pull bar support C1.

Referring to FIG. 2, the individual reinforcing detail of each pull bar support can be set forth. Each pull bar support C includes a rectangular bar receptacle 30. The bar receptacle has a top plate 31, a bottom plate 32, and two side plates 33 and 34. As can be seen, the receptacle 30 is typically embedded within the sidewalls of the concrete tower here denoted as 36.

Reinforcing for the support of such receptacles is critical. Accordingly, a first vertically disposed I-beam 40 is placed immediately below plate 32 of receptacle 30 to define on plate 32 a support surface 36 in wall 32 of the receptacle 30. Similarly, a second vertical I-beam defines a support surface 37 on the upper plate 31 of the receptacle 30.

As will hereinafter be explained, the pull bar 50, when used for the support of floors, is pulled partially out of but not entirely without the receptacle 30. When this occurs, its medial lower portion will rest on support surface 36. Likewise, its end section interior of receptacle 30 will come to rest upwardly on support surface 37. Thus, to resist the supporting moment exerted on the pull bar, the support surfaces 36 and 37 are not in vertical alignment one with another, but are displaced so that they may resist a downward moment on the pull bar 50 when it is extended in its cantilevered supported relationship to the receptacle 30.

Typically, both of the vertical beams 40 and 42 are provided with a matrix of reinforcing bar. This matrix of reinforcing bar allows the respective vertical beams 40 and 42 to cure integrally with the concrete sidewalls of the tower. Thus, vertical beam 40 is reinforced and held in place by a matrix of reinforcing bar 44. Similarly, vertical beam 42 is held in place by a matrix of reinforcing bar 46. Each of these matrices of reinforcing bar is welded to the beams 40 and 42 at numerous welds (not shown).

Referring to FIGS. 3, 4 and 5, the function of the pull bar can easily be understood. As shown in FIG. 4, the pull bar 50 includes an upper bearing surface 52 in the form of a flat plate welded across the rear surface of the pull bar 50. Additionally, the pull bar includes a lower and medial bearing surface 54 in the form of a plate welded across the bottom medial portion of the pull bar 50. When the pull bar is extended and loaded as shown in FIG. 5, bearing surface 52 on bar 50 comes into confrontation with bearing surface 37 on receptacle 30. Likewise, bearing surface 54 comes into confrontation with bearing surface 36 at the bottom of receptacle 30.

Operation of the invention can be easily understood. Referring to FIG. 2, the receptacle 30 with its vertical beams 40 and 42 is embedded interior of the column sidewalls, typically by means of a slip forming process. A pull bar 50 is placed from the open end of the receptacle inwardly to its end. The pull bar is left in this disposition until the floors are raised.

Once the floors are raised, they are raised slightly above their intended elevation. At this juncture, an eye bolt 55 is threaded into the end of the pull bars and the pull bars are moved outwardly underlying to respective floor beams 22. Once the pull bars are in position, the floors are lowered on their upper surface, and the pull bars in the cantilevered disposition serve to maintain the floors rigidly affixed to the tower sidewalls.

It should be apparent that as the number of floors increase, the number of levels of pull bars that are used to fasten the floor to the tower sidewalls will likewise increase. Likewise, it should be apparent that a number of modifications can be made to the disclosed invention without departing from the spirit and scope thereof.

I claim:

1. Apparatus for the support of a floor about at least one tower to permit a floor to be raised immediately adjacent the sidewalls of said tower and above the intended elevation of said floor and thereafter lowered onto said apparatus for the support of said floor from said tower, said apparatus comprising: a plurality of substantially horizontally disposed receptacles defined within the sidewalls of said tower immediately below the elevation of said floor, said receptacles having an elongate dimension opening at one end to the exterior or the sidewalls of said tower, said receptacles having a preselected cross section across their elongated dimension to define upper and lower supporting surfaces for supporting the weight of said floor; a correspondent plurality of bars disposed within said receptacles, said bars having an elongated dimensions from end to end to permit said bars to fit within said receptacles to define along the sidewalls of said tower an unobstructed surface permitting said floors to be raised immediately past said receptacles with said bars therewithin; means attached to said bars for permitting said bars to be withdrawn from said receptacles to protrude under said floors in supporting relation; and, upper and lower bearing surfaces on said bars corresponding in location to the upper and lower supporting surfaces in said supporting surfaces in said receptacles when said bars are partially withdrawn for load supporting contact with said receptacles to provide a cantilever support to said bars to permit support of said floor when resting thereon.

2. The invention of claim 1 and wherein said upper and lower supporting surfaces of said receptacles are provided with respective upper and lower vertically extending reinforcement members.

3. The invention of claim 1 and wherein said means for permitting said bars to be withdrawn from said receptacles comprises and eye threaded to the exposed end of said bar when said bar is fully disposed within said receptacle.

4. A building comprising: at least one tower including substantially vertical tower sidewalls; a floor constructed about the periphery of said tower defining an aperture at said tower; a plurality of substantially horizontally disposed receptacles defined within the sidewalls of said tower immediately below the intended elevation of said floor, said receptacles having an elongate dimension opening at one end to the exterior of the sidewalls of said tower, said receptacles further having a preselected cross section across their elongate dimension to define upper and lower supporting surfaces for supporting the weight of said floors; a correspondent plurality of bars disposed within said receptacles, said bars having an elongate dimension from end to end to permit said bars to fit within said receptacles to define along the sidewalls of said tower an unobstructed surface for permitting said floors to be raised immediately past said receptacles with said bars there within; upper and lower bearing surfaces on said bars corresponding in location to said upper and lower supporting surfaces in said receptacles when said bars are partially withdrawn for load supporting contact with said receptacles to provide a cantilever support to said bars to permit support of said floor when resting thereon.

5. The apparatus of claim 4 and wherein said towers are rectangular and the apertures in said floor are likewise rectangular.

6. The invention of claim 4 and wherein said building includes two towers.

7. The invention of claim 4 and wherein said building includes four receptacles and four pull bars with two receptacles and pull bars being disposed on one side of a tower and two receptacles and pull bars being disposed on the other side of said tower.

8. In a building construction of the type having at least one centrally located upright tower, a plurality of horizontal, vertically spaced apart floors completely surrounding the tower, and means for supporting the floors from the tower, the improvement of the floor supporting means comprising: a plurality of generally horizontally oriented receptacles for each floor, each receptacle having an elongate configuration, a first, closed end disposed interiorly of the tower and a second, open end flush with a side of the tower; an elongate pull bar disposed in each receptacle, the pull bar having a lesser cross section than an interior cross section of the receptacle and a length so that it can be completely received within the receptacle; and means defining lower and upper, longitudinally spaced apart contact surfaces between the receptacle and the pull bar, the surface defining means being located relatively proximate the open end and relatively remote from the open end of the receptacle, respectively, the contact surfaces having a vertical spacing so that the pull bar is in a horizontal orientation when the floor is carried by the pull bar and the contact surfaces are in mutual engagement.

9. A building according to claim 8 wherein the receptacle is embedded in concrete, and including vertically oriented reinforcement bars disposed exteriorly of the receptacle and in contact with exterior sides of the receptacle is substantial vertical alignment with the lower and upper contact surfaces when the pull bar is in a floor supporting position.

10. A building according to claim 8 wherein the contact surface defining means comprises plate means disposed between upper and lower opposing surfaces of the pull bar and the receptacle.

11. A building according to claim 10 wherein the plate means comprises shims attached to upper and lower surfaces of the pull bar.

12. A building according to claim 8 wherein the floor comprises horizontally disposed beams and a floor member carried by and disposed above the beams, and wherein the elevation of the pull bar is below the elevation of the beams.

13. A building comprising in combination:

at least one upright tower and a plurality of vertically spaced apart floors completely surrounding the tower, each floor including a floor member carried by a plurality of elongate beams, the beams being positioned closely adjacent side walls of the tower;

a plurality of elongate, substantially horizontally disposed receptacles for each floor and terminating in open ends that are flush with the tower side walls, each receptacle having upper and lower walls extending from the opening into the tower;

an elongate pull bar disposed in each receptacle the pull bar having a length no greater than the length of the receptacle so that it can be completely disposed within the receptacle without protruding past the side wall, the pull bar having a lesser height than the spacing between the upper and lower receptacle walls to facilitate longitudinal movement of the pool bar within the receptacle;

first and second shim means disposed between the upper receptacle wall and an upper side of the pull bar and between a lower receptacle wall and a lower side of the pull bar, respectively, the second shim means being disposed proximate the receptacle opening and the first shim means being spaced from the second shim means in the direction of the receptacle length and positioned relatively remote from the receptacle opening, the shim means having thicknesses so that the pull bar is in a horizontal orientation when the pool bar is partially withdrawn from the receptacle and supports the floor beam; and means for engaging the pull bar and longitudinally moving it within the receptacle;

whereby the pull bar can be retracted within the receptacle while the floor is raised past and above the receptacle and is readily moved longitudinally within the receptacle in an orientation which is inclined from the horizontal to prevent high friction contact between the receptacle walls, the pool bar and the shim means.

14. A building according to claim 13 and further including first and second, vertically oriented support beams anchored to the tower, disposed exteriorly of and in contact with the upper and lower receptacle walls, respectively, and aligned with the first and second shim means, respectively, when the pool bar is partially withdrawn from the receptacle and supports the floor beam.

15. A building according to claim 14 wherein the tower is at least partially constructed of concrete, and wherein the receptacle and the first and second vertical support beams are embedded in concrete.

16. A building according to claim 13 wherein the shim means comprises plate members attached to the upper and lower pull bar sides, the plate members being spaced apart with respect to each other and having a dimension in the direction of the pull bar length which is substantially less than the length of a portion of the pull bar disposed within the receptacle when the pull bar supports the floor beam.

17. Apparatus for supporting a floor about at least one tower permitting the floor to be raised along side walls of the tower to above the intended elevation of the floor and to be thereafter lowered onto the apparatus for the support of the floor from the tower, the apparatus comprising: a plurality of substantially horizontally disposed, elongate receptacles, each receptacle having an opening that is flush with the side walls and extending into the interior of the tower, the receptacle having a vertically elongate cross section including upper and lower, parallel receptacle walls; an elongate pull bar disposed in each receptacle and having a length no greater than the length of the receptacle, the pull bar having a vertically elongate cross section complementary to the cross section of the receptacle and a vertical extent less than the vertical spacing between the receptacle walls; and spacing means reducing the effective vertical spacing between the upper and the lower receptacle wall and corresponding opposite surfaces of the pull bar at two longitudinally spaced apart points, a portion of the spacing means between the lower receptacle wall and the opposing pull bar side being disposed relatively proximate the receptacle opening and another portion of the spacing means between the upper receptacle wall and the opposing upper pull bar surface being disposed relatively remote from the receptacle opening, the spacing means transmitting floor supporting forces via the portions to the upper and lower receptacle walls at points relatively remote and relatively proximate the receptacle opening, respectively; whereby the pull bar can be moved longitudinally of the receptacle by angularly inclining the bar relative to the horizontal; and whereby the pull bar is maintained in a horizontal position when partially withdrawn from the receptacle and supporting the floor.

18. Apparatus according to claim 17 including means disposed exteriorly of the receptacle for reinforcing section of the upper and the lower receptacle walls aligned with the two portions of the spacing means.

19. Apparatus according to claim 18 wherein the portions of the spacing means comprises first and second plate means having a combined thickness about equal to the height difference between the pull bar and interior surfaces of the receptacle walls.

20. Apparatus according to claim 19 wherein the first plate means is attached to the pull bar adjacent an aft end of the pull bar disposed within the receptacle and wherein the second plate means is attached to the pull bar at a point spaced from ends of the pull bar.

* * * * *